US005188296A

United States Patent [19]

Duez et al.

[11] Patent Number: 5,188,296

[45] Date of Patent: Feb. 23, 1993

[54] PULP DISPERSION LANCE

[75] Inventors: Christian Duez, Voisins Les Bretonneux; Jean-Claude Semedard, Paris; Jean-Xavier Morin, Neuville Aux Bois, all of France

[73] Assignee: Stein Industrie, Velizy-Villacoublay, France

[21] Appl. No.: 679,495

[22] Filed: Apr. 2, 1991

[30] Foreign Application Priority Data

Apr. 2, 1990 [FR] France ..... 90 04200

[51] Int. Cl.[5] ..... B05B 7/10

[52] U.S. Cl. ..... 239/403; 239/427.3; 239/429; 406/92; 406/95

[58] Field of Search ..... 406/92, 94, 95, 153, 406/193, 194; 239/143, 403, 405, 406, 427, 429, 433, 427.3

[56] References Cited

U.S. PATENT DOCUMENTS

| | | | |
|---|---|---|---|
| 857,096 | 6/1907 | McCord | 406/92 |
| 1,051,905 | 2/1913 | McCord | 406/92 |
| 1,451,063 | 4/1923 | Anthony | 239/406 |
| 2,946,628 | 7/1960 | Bauregger | 406/95 |
| 3,840,181 | 10/1974 | Vier et al. | 239/406 |
| 3,897,007 | 7/1975 | Roy | 239/403 |
| 4,011,995 | 3/1977 | Krause, Jr. | 239/406 |
| 4,796,814 | 1/1989 | Klemm et al. | 239/433 |

FOREIGN PATENT DOCUMENTS

| | | | |
|---|---|---|---|
| 0751940 | 7/1980 | U.S.S.R. | 239/143 |
| 685420 | 1/1953 | United Kingdom | 239/143 |

OTHER PUBLICATIONS

Patent Abstracts of Japan, vol. 10, No. 257 (M-513) [2313], Sep. 3, 1986; & JP-A-61 83 817 (Babcock Hitachi K.K.).

*Primary Examiner*—Andres Kashnikow
*Assistant Examiner*—Christopher G. Trainor
*Attorney, Agent, or Firm*—Sughrue, Mion, Zinn, Macpeak & Seas

[57] ABSTRACT

The lance of the invention includes a sleeve (2A) which conveys air under pressure around a central tube (1) which conveys the pulp that is to be sprayed and dispersed. The wall of this tube is pierced by separation holes (5) to inject a gaseous lining around the pulp, by break-up holes (3) for breaking up said pulp, and by rotation-imparting holes (4) in the vicinity of the outlet (1B) from the lance. The invention is particularly applicable to feeding a boiler with coal powder.

8 Claims, 2 Drawing Sheets

PULP DISPERSION LANCE

The present invention relates to a device for spraying and dispersing pulp by means of a driving gas. The device is called a "lance" herein since it is typically, although not necessarily, elongate in shape.

"Pulp" is defined as a liquid or semi-liquid substance obtained by mixing together a solid and a liquid plus possible additives for reducing viscosity, which substance is suitable for being driven by means of pumps. It may be constituted, in particular, by coal powder and water sprayed by the lance into a boiler for the purpose of being burnt therein.

A characteristic of a pulp is that it is a substance which is often very viscous or pasty and is usually highly abrasive, thereby making it difficult to handle by means of pumps (generally of the concrete pump type) and as a result it cannot be sprayed using the same methods as are used for less viscous fluids such as water or heating oil, for example. In particular, the speed at which pump is conveyed generally lies in the range 0.1 meters per second (m/sec) to 2 m/sec.

A first prior pulp spray lance comprises the following items which it has in common with a lance of the present invention:

- a central tube for transporting the pulp;
- a sleeve surrounding the tube and constituting an annular duct which is fed with a driving gas under pressure; and
- dispersion orifices passing through the wall of the tube to inject the driving gas therein.

The gas jets formed in this way disperse and accelerate the pulp so that it forms a jet on leaving the tube. In this first prior lance, the gas jets are radial. They break up the column of pulp and they impart high axial speed thereto. They thus create a jet which is long and concentrated. The results obtained with lances of this type fall off very quickly when the water content is reduced and the pulp becomes highly viscous.

Other types of pulp lance are known in which air is injected at their ends via an annular duct. The air is designed to penetrate into the pulp jet and to disperse it. These lances are not suitable for high viscosities since the air does not penetrate far enough into the pulp and the resulting pulp jet is poorly dispersed.

A particular object of the present invention is to enable pulp to be dispersed effectively even when the liquid content of the pulp is relatively low.

To this end, the present invention provides a lance including the above-mentioned common items, and which, compared to the first above-mentioned prior lance, is characterized by the fact that some of the dispersion orifices are orifices for imparting rotation having sloping axes to cause the pulp to rotate rapidly and which are situated at suitably selected distances from the end of the central tube.

An implementation of the present invention is described below with reference to the accompanying diagrammatic figures, it being understood that the items and dispositions mentioned and shown are given purely by way of non-limiting example. When the same items appears in more than one of the figures, it is designated therein by the same reference symbol.

Figure 6:
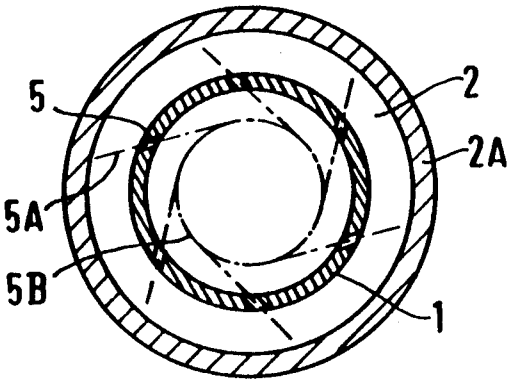
Figure 2:
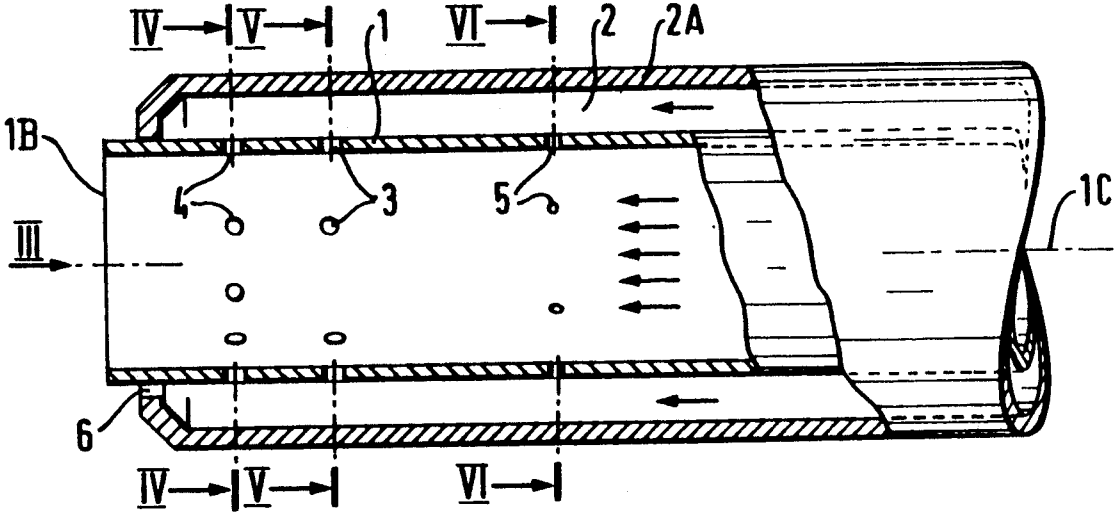
FIG. 2 is an axial section through the spout constituted by the downstream end of the lance.
Figure 5:
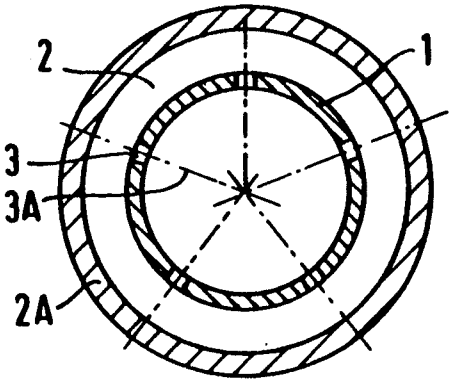
Figure 4:
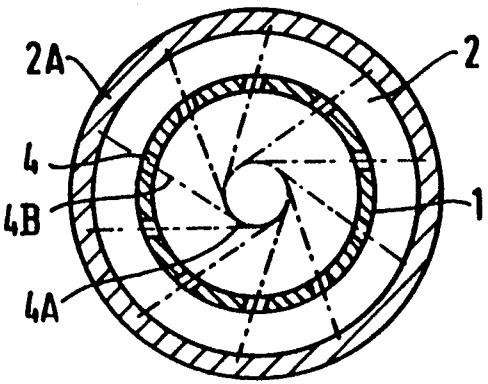

FIGS. 4, 5, and 6 are cross-sections through the lance on planes IV—IV, V—V, and VI—VI of FIG. 2.

The various dispositions adopted in the lance given by way of example are initially described in general terms with reference to the figures, it being understood that these dispositions could be implemented differently.

Some of these dispositions are already known. These known dispositions of the lance comprise the following:

A central tube 1. The axis of this tube constitutes the axis 1C of the lance. It defines a longitudinal direction. Radial and circumferential transverse directions may be defined at any point relative to said axis. The function of the tube is to convey a pulp from a pulp inlet 1A formed at an upstream end of the tuber to a lance outlet 1B formed at a downstream end of the tube. The section of the tube does not taper along the length of the lance so as to avoid presenting any obstacle to pulp advance. The section may be constant, for example.

Pulp feed means 12 for feeding said pulp inlet.

A sleeve 2A surrounding the central tube 1 and constituting an annular duct around the tube.

Gas feed means 14 for injecting a driving gas under pressure into the upstream portion of the annular duct.

Circumferentially distributed or spaced dispersion orifices 3, 4 pass through the wall of the central tube. The driving gas is injected through the orifices into the tube from the annular duct, thereby dispersing and accelerating the pulp so that it forms a jet on leaving the tube.

Other dispositions are novel. Some of these novel dispositions seek, in particular, to improve pulp dispersion on leaving the lance. They are as follows:

At least some of the dispersion orifices are orifices 4 for imparting rotation. They are circumferentially distributed and each of them is of sufficient length to form rotation-imparting jets from the driving gas, which jets are directed along and centered on the axes of these orifices. These axes are oblique. More precisely, relative to the radial directions of the lance, these orifices are sufficiently inclined in planes transverse to the lance for a circumferential component of the velocity of the rotation-imparting jets to entrain the pulp in rapid rotation inside the central tube. These orifices are situated at sufficient distance from the end of the central tube to ensure that the driving gas mixes at least in part with the pulp before it leaves the tube, thereby imparting rotation to the pulp, said distance being simultaneously short enough for the pulp to retain a significant fraction of the rotational energy it acquires in this way right up to exiting from the central tube. The pulp thus rotates rapidly, and as a result the jet of pulp flares out into a conical shape. More particularly, this distance lies in the range 60% to 200% of the radius of the central tube 1, and preferably in the range 75% to 150% of said radius. Yet more particularly, this distance is advantageously substantially equal to said radius.

The lance includes two series of dispersion orifices. One is a breaking-up series constituted by breaking-up orifices 3 pierced at such a distance from the outlet of the lance 1B as to ensure that the driving gas forms breaking-up jets directed towards the lance axis 1C. The other series is a rotation-imparting series disposed downstream from the breaking-up series and constituted by the rotation-imparting orifices 4.

The axes 4B of the orifices 4 pass at least twice as far from the lance axis 1C as do the axes 3A of the breaking-up orifices 3.

They are tangential to a cylinder 4A which is coaxial with the central tube 1 and which has a radius lying in the range 16% to 75% of the inside radius of the tube.

The breaking-up series 3 is separated from the rotation-imparting series 4 by an axial distance lying in the range 20% to 400% of the inside radius of the central tube 1.

The ratio of driving gas mass flow rate to the mass flow rate of the pulp to be dispersed lies in the range 0.005 (five thousandths) and 0.4 (four tenths).

Other novel dispositions seek above all to limit head loss inside the central tube. They are as follows:

The lance includes a series of separation orifices 5 passing through the wall of the central tube 1 upstream from the dispersion orifices 3 and 4. These separation orifices enable a limited flow rate of driving gas to penetrate into the tube from the annular duct 2 and to form a gaseous lining against the inside surface of the tube. This gaseous lining surrounds the pulp up to the dispersion orifices or, more particularly, up to the breaking-up orifices 3. It facilitates pulp flow in this length of the lance.

To do this, the axial distance between the separation orifices 5 and the dispersion orifices 3 lie in the range 20% to 400% of the inside radius of the central tube 1.

The overall flow section presented to the driving gas by the separation orifices 5 is less than 40% and preferably less than 10% of the section presented by the dispersion orifices 3 and 4.

The separation orifices 5 are long enough to enable the driving gas to form separation jets which are directed and centered on the axes 5A of the these orifices. These axes are oblique and relative to radial directions of the lance they are sufficiently inclined to ensure that the separation jets penetrate a moderate distance only into the column of pulp flowing along the central tube 1.

They are tangential to a cylinder 5B which is coaxial with the central tube 1 and whose radius is not less than 70% of the inside radius of said tube.

The effectiveness of these dispositions is due to the fact that the break-up jets tend very particularly to slow down advance of the pulp through the length of central tube situated upstream therefrom. The presence of the gaseous lining inside this length counters the slowing down effect.

The lance given by way of example is now described more particularly.

Figure 1:
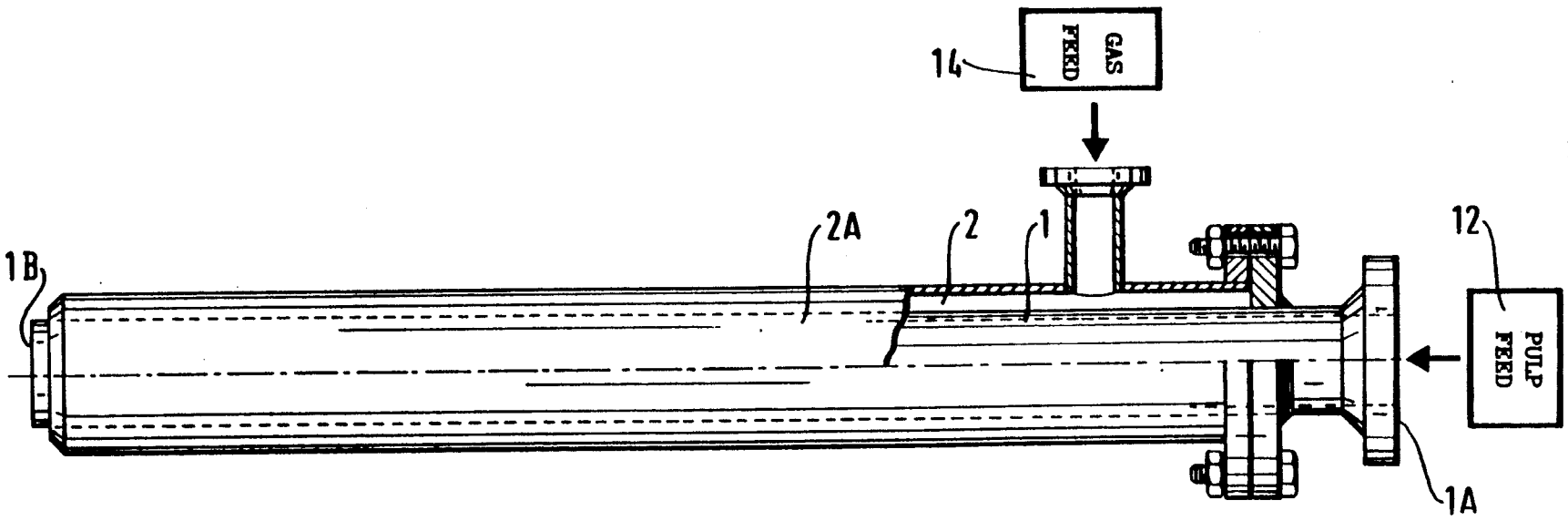
FIG. 1 is an overall elevation view of a lance of the present invention.
Figure 3:
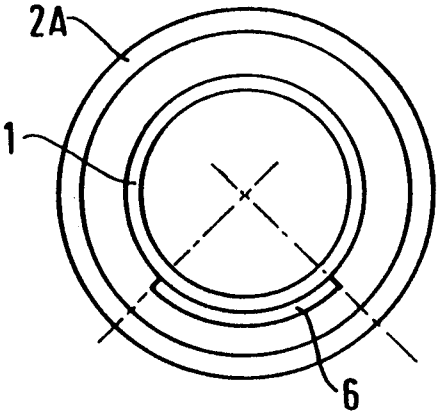
FIG. 3 is an end view of the lance.

It is constituted by a cylindrical central tube 1 having an inside radius of 32.5 mm and a thickness of 5 mm, and a concentric annular duct 2 which is constituted by a sleeve 2A fixed on the tube 1 and which is closed at the downstream end of the tube 1 either completely or leaving a small amount of clearance 6, FIG. 1.

The pulp flows along the central tube 1 under a pressure of 5,000 Pascals provided by a pump 12 which constitutes said pump feed means. The driving gas flows inside the annular duct 2. It is constituted by air which is compressed by a compressor 14 that provides a pressure of 30,000 Pascals and which constitutes said gas feed means. It is injected into the pulp at the end of the lance via three series of calibrated orifices 3, 4, and 5 opening out into the central tube. Each of these series is constituted by orifices distributed circumferentially in a transverse plane.

One of the series of orifices 3 constitutes the break-up orifices. The driving gas is to be injected into the column of pulp in such a manner as to break it up. The axes of these orifices are preferably more or less radial or directed in such a manner as to penetrate into an imaginary cylinder concentric with the pulp duct and having a radius of not more than ⅓ of the radius of the central tube. These orifices may be five in number and they may be 6.5 mm in diameter, for example.

Another series of orifices 4 constitutes the rotation-imparting orifices. This series is intended to inject the driving gas tangentially to the pulp flow. The gas then imparts a high rotary speed to the pulp and establishes a film of pulp over the inside surface of the central tube 1. This film of pulp explodes and spreads out in the form of a cone on leaving the outlet orifice 1B of the lance. The axes 4A of these orifices are tangential to an imaginary circle 4B having a radius lying in the range ¾ to 1/6 of the radius of the central tube 1. There may be ten of these orifices and they may be 6.5 mm in diameter, for example.

A series of separation orifices 5 is added to establish a thin lining of gas around the pulp to facilitate pulp flow. These orifices are disposed upstream from the break-up series and the rotation-imparting series. They may be six of them and they may be 3 mm in diameter, for example.

Their axes are tangential to an imaginary circle whose radius is not less than 0.7 times the inside radius of the central tube.

In order to prevent particles of pulp sticking to or dripping from the tip of the lance, clearance 6 is maintained between the end of the sleeve 2A and the central tube 1. This clearance lies in the range 0.01 times to 0.1 times the inside radius of the central tube.

The jet of gas passing through this clearance is intended to cause any drops of pulp to be thrown off a long way. The clearance is provided only in the bottom portion of the lance when the lance is in a position that is horizontal or nearly horizontal, and in that case it extends over an arc whose angle at the center is at least 60°.

The present invention is particularly suitable for injecting a pulp of coal or carbon-containing material into the hearths of fluidized bed boilers, since the rotary speed imparted to the pulp by the driving gas gives rise to a jet that spreads considerably, thereby enabling the pulp to be well distributed inside the boiler hearth.

The downstream end of the lance is then made ether of refractory steel or else or ceramic in order to limit wear due to temperature and abrasion by the solid particles in the pulp.

Although the lance given by way of example is designed to inject pulp into a fluidized bed boiler under atmospheric pressure, the invention is also applicable to injecting into enclosures maintained under pressure, and in particular into fluidized beds or gassy fires under pressure.

For example, the total pulp flow rate may be 20 $m^3/h$ and the air flow rate may be 700 $m^3/h$.

The viscosity of the pulp may be such that, for example, that its head loss in a pipe of 100 mm diameter at a flow rate of 10 $m^3/h$ lies in the range 100 Pascals to 100,000 Pascals.

It should be observed that such viscosities are very different from the viscosities of certain fuels known in the art but which are not pulps, which fuels are called "coal water slurry fuel", or "coat water mixture (CWM)". These prior fuels have a viscosity such that the headloss in a pipe of 100 mm diameter at a flow rate of 10 $m^3/h$ is typically 20 Pascals and is in all cases less than 70 Pascals.

A prior lance suitable for dispersing such a fuel is described in the document Patent Abstracts of Japan Vol. 10, No. 257 (Babcock Hitachi K. K.). It includes a chamber for separating particles according to their diameters in which an emulsion formed by the fuel and steam is set into rotation by holes injecting steam tangentially. The fuel separated and emulsified in this way passes through an axial outlet orifices 25 and peripheral orifices 24 of diameter that is much too small for dispersing a pulp of coal.

We claim:

1. In a pulp dispersion lance comprising:

a central tube (1) extending longitudinally without reduction in section along a lance axis (1C) having a pulp inlet (1A) formed at an upstream end of the central tube and a lance outlet (1B) formed at a downstream end of the central tube;

pulp feed means (12) for feeding pulp to said pulp inlet;

a sleeve extending concentrically about said central tube and spaced therefrom and defining with said central tube a longitudinally extending gas duct (2);

gas feed means (14) opening to said sleeve at an upstream end of said gas duct for injecting a driving gas under pressure into an upstream portion of said gas duct; and dispersion orifices (3, 4) passing through a wall of the central tube to inject the driving gas into the tube from the gas duct to disperse and accelerate the pulp so that said pulp forms a jet on leaving the central tube lense outlet 1B;

the improvement wherein at least some of the dispersion orifices constitute a series of circumferentially distributed rotation-imparting orifices (4) of sufficient length to form rotation-imparting jets of the driving gas, said jets being directed and centered on axes (4A) of said orifices which extend obliquely and have components in transverse planes of the lance which slope sufficiently relative to radial directions of the lance for a circumferential component of the rotation-imparting jets to cause the pulp to rotate rapidly inside said central tube (1) up to said downstream end (1B), the series of rotation-imparting orifices (4) being at an axial distance from said downstream end (1B) lying in the range of 60% to 200% of an inside radius of said central tube, and wherein said dispersion orifices include a break-up series constituted by break-up orifices (3) pierced at a distance from the lance outlet (1B) such that the driving gas forms break-up jets in the direction towards the lance axis (1C), and said rotation-imparting series formed downstream from the break-up series.

2. A lance according to claim 1, characterized by the fact that said axial distance of the rotation-imparting orifices (4) from the downstream end (1B) of the central tube (1) lies in the range 75% to 150% of the inside radius of the tube.

3. A lance according to claim 2, characterized by the fact that said axial distance of the rotation-imparting orifices (4) from the downstream end (1B) of the central tube (1) is substantially equal to the inside radius of the tube.

4. A lance according to claim 1, characterized by the fact that the axes (4A) of the rotation-imparting orifices (4) pass at least twice as far from the lance axis (1C) as the axes (3A) of the break-up orifices (3).

5. A lance according to claim 1, characterized by the fact that the axes (4A) of the rotation-imparting orifices (4) are tangential to a cylinder (4B) which is coaxial with the central tube (1) and which has a radius lying in the range 16% to 75% of an inside radius of the tube.

6. A lance according to claim 1, characterized by the fact that the break-up series (3) is separated from the rotation-imparting series (4) by an axial distance lying in the range 20% to 400% of the inside radius of the central tube (1).

7. A lance according to claim 2, having said axis (1C) extending away from the vertical, and further comprising an axial outlet gap (6) within said sleeve for the driving gas opening to the outside at the downstream end of the central tube (1) over a lower portion only at the circumference of the central tube.

8. A lance according to claim 7, wherein said outlet gap (6) extends over an arc of at least 60°.

* * * * *